US006135149A

United States Patent [19]

Nozawa et al.

[11] Patent Number: 6,135,149

[45] Date of Patent: Oct. 24, 2000

[54] PRESSURE COMPENSATING VALVES

[75] Inventors: Yusaku Nozawa, Ibaraki-ken; Yoshizumi Nishimura, Tsuchiura; Nobuhiko Ichiki; Minoru Aoki, both of Ibaraki-ken; Kinya Takahashi, Tsuchiura, all of Japan

[73] Assignee: Hitachi Construction Machinery Co., Ltd., Tokyo, Japan

[21] Appl. No.: 09/367,232

[22] PCT Filed: Jan. 11, 1999

[86] PCT No.: PCT/JP99/00051

§ 371 Date: Aug. 11, 1999

§ 102(e) Date: Aug. 11, 1999

[87] PCT Pub. No.: WO99/35408

PCT Pub. Date: Jul. 15, 1999

[30] Foreign Application Priority Data

Jan. 12, 1998 [JP] Japan ..... 10-003726

[51] Int. Cl.[7] ..... F15B 13/08; F15B 11/05

[52] U.S. Cl. ..... 137/596.13; 60/452; 91/446; 137/596

[58] Field of Search ..... 60/452; 91/446; 137/596, 596.13

[56] References Cited

FOREIGN PATENT DOCUMENTS 60-11706 1/1985 Japan .

4-244605 9/1992 Japan .

4-312202 11/1992 Japan .

6-40409 5/1994 Japan .

*Primary Examiner*—Gerald A. Michalsky

*Attorney, Agent, or Firm*—Mattingly, Stanger & Malur, P.C.

[57] ABSTRACT

Pressure compensating valves disposed at inlet sides of directional control valves are each configured with a step-shaped spool having a larger diameter portion and smaller diameter portions and pressure receiving chambers are provided to sandwich the larger diameter portion such that a pump delivery pressure and an inlet pressure of a metering throttle of the directional control valve acts in the chambers, respectively, and further pressure receiving chambers are provided at respective ends of the smaller diameter portions such that an outlet pressure of the metering throttle and a signal pressure act in the chambers, respectively. A check valve operated by the outlet pressure of the metering throttle is fitted in the smaller diameter end portion positioned on the side of the pressure receiving chamber to reduce the pump delivery pressure and produce a signal pressure. A sleeve having opposed ends positioned in a pressure receiving chamber in which the outlet pressure of the metering throttle is introduced and in the pressure receiving chamber is fitted on the smaller diameter portion, and the outlet pressure of the metering throttle is introduced to the pressure receiving chamber by movement of the sleeve.

3 Claims, 6 Drawing Sheets

PRESSURE COMPENSATING VALVES

TECHNICAL FIELD

The present invention relates to a pressure compensating valve used for a hydraulic circuit distributing and supplying a hydraulic fluid delivered from one hydraulic pump to a plurality of actuators.

BACKGROUND ART

When a hydraulic fluid delivered from one hydraulic pump is supplied to a plurality of actuators, the hydraulic fluid is supplied only to the actuator having a lower load pressure and thus as a proposal for dissolving the problem, there has been known a hydraulic circuit disclosed in JP, A 60-11706, for example. This hydraulic circuit is shown in FIG. 6.

In FIG. 6, a delivery line 102 of a hydraulic pump 101 is connected to actuators 106, 116 via a valve unit 150. The valve unit 150 comprises pressure compensating valves 103, 113, hold check valves 104*a*, 114*a*, directional control valves 105, 115, and a shuttle valve 107. The pressure compensating valves 103, 113 are connected in parallel to the delivery line 102, and the directional control valves 105, 115 are respectively connected to outlet lines 104, 114 of the pressure compensating valves 103, 113 through the hold check valves 104*a*, 114*a* and outlet sides of the respective directional control valves 105, 115 are respectively connected to the actuators 106, 116. The pressure compensating valves 103, 113 are configured to be urged in their opening directions by a delivery pressure of the hydraulic pump 101 and outlet pressures of the directional control valves 105, 115 and to be urged in their closing directions by inlet pressures of the directional control valves 105, 115 and the highest load pressure. The shuttle valve 107 compares the load pressures of the actuators 106, 116 to select the higher one thereof to supply the same to the pressure compensating valves 103, 113 and a load sensing valve 120. With such a circuit structure, when the plurality of the directional control valves 103, 113 are operated simultaneously, a hydraulic fluid delivered from the hydraulic pump 101 is supplied to the respective actuators 106, 116 at a predetermined distribution ratio by the function of the pressure compensating valves 103, 113.

DISCLOSURE OF THE INVENTION

As mentioned above, the hold check valves 104*a*, 114*a* are essential for the valve unit 150 for driving the actuators 106, 116. The hold check valves 104*a*, 114*a* are provided for preventing reverse flows of the pressure fluids from the actuators to hold the position thereof when the delivery pressure of the hydraulic pump 101 is lower than the load pressure in a case where the directional control valves 105, 115 are being operated, for example, at a starting time of the actuators or at a time when the loads acting on the actuators have been increased. For this reason, in the valve unit 150, a space is required for providing the hold check valves 104*a*, 114*a* in the outlet lines 104, 114 of the pressure compensating valves 103, 113.

Also, in the valve unit 150 provided with the pressure compensating valves 103, 113 shown in FIG. 6, it is necessary to provide the shuttle valve 107 for comparing the load pressures of the actuators to supply the higher one to the pressure compensating valves. Thus, in the valve unit 150, a space is also required for providing the shuttle valve 107 in signal fluid lines 108, 118.

Consequently, the entire valve unit 150 including the pressure compensating valves 103, 113 and the directional control valves 105, 115 is large-sized and the structure of the valve 150 becomes complicated, thereby increasing the manufacturing cost.

Also, in the hydraulic circuit shown in FIG. 6, assuming that, when the two actuators 106, 112 are operated together, the load pressure of the actuator 106 is larger than that of the actuator 112, the pressure in the line 108 in the valve 150 is introduced to a line 109 via the shuttle valve 107 as the highest pressure. Further, assuming that the load pressure of the actuator 116 becomes larger than that of the actuator 106 due to variation of the load pressures, when the shuttle valve 107 is switched, ventilation occurs from the side of the line 118 to the side of the line 108, so that the actuator 106 may be accelerated instantaneously. It is not preferable that such a phenomenon occurs during a high accuracy finishing construction work.

A first object of the present invention is to provide a pressure compensating valve in which it is not necessary to provide a hold check valve between the pressure compensating valve and a directional control valve so that a valve unit can be simplified.

A second object of the present invention is to provide a pressure compensating valve in which it is not necessary to provide a portion for arranging a shuttle valve in load pressure signal lines so that a valve unit can be simplified.

A third object of the present invention is to provide a pressure compensating valve in which an abnormal operation of an actuator generated due to the load pressure detection and the transmission of the highest load pressure when the magnitudes of the load pressures are reversed is prevented from occurring, and thus an operation of the actuator is not deteriorated.

(1) To achieve the above first object, the present invention provides a pressure compensating valve disposed at an inlet side of a metering throttle of a directional control valve for controlling a differential pressure between inlet and outlet pressures of the metering throttle so that the differential pressure corresponds to a differential pressure between a delivery pressure of a hydraulic pump and a signal pressure in a signal line, comprising : a step-shaped spool having a larger diameter portion and smaller diameter portions positioned at opposed sides of the larger diameter portion, the larger diameter portion being formed with flow control notches; first and second pressure receiving chambers disposed to-sandwich the larger diameter portion of the spool for respectively applying a delivery pressure of the hydraulic pump in a direction opening the flow control notches and the inlet pressure of the metering throttle of the directional control valve in a direction closing the flow control notches; a third pressure receiving chamber disposed at an end of the smaller diameter portion of the spool on the same side as the first pressure receiving chamber; a fourth pressure receiving chamber disposed at an end of the smaller diameter portion on the same side as the second pressure receiving chamber; a fifth pressure receiving chamber disposed on the same side as the third pressure receiving chamber with respect to the larger diameter portion and, to which the outlet pressure of the metering throttle is introduced; and a sleeve slidably fitted on an outer periphery of the smaller diameter portion of the spool on the same side as the first pressure receiving chamber and having opposed ends respectively positioned in the first pressure receiving chamber and the fifth pressure receiving chamber whereby the sleeve is moved so as to introduce the outlet pressure of the metering throttle to the third pressure receiving chamber when the delivery pressure of the hydraulic pump in the first pressure receiving chamber becomes higher than outlet pressure of the metering throttle in the fifth pressure receiving chamber.

By providing the first to fifth pressure receiving chambers and fitting the sleeve on the outer periphery of the smaller diameter portion of the spool in such a manner, when the directional control valve is operated, the sleeve is not moved while the delivery pressure of the hydraulic pump is lower than the outlet pressure of the metering throttle (the load pressure acting on the actuator), and thus the outlet pressure of the metering throttle is not introduced in the third pressure receiving chamber. Accordingly, the spool is held at a position where the control notches of the larger diameter portion are closed, and the communication between the first pressure receiving chamber and the second pressure receiving chamber is cut off, so that a reverse flow of the load pressure is prevented from occurring.

When the delivery pressure of the hydraulic pump is raised to exceed the outlet pressure of the metering throttle (the load pressure of the actuator), the sleeve is moved so as to introduce the outlet pressure of the metering throttle to the third pressure receiving chamber. Thus, the spool is moved in the direction to open the control notches of the larger diameter portion, and the first and second pressure receiving chambers are brought into communication with each other, so that hydraulic fluid of the hydraulic pump is supplied to the directional control valve.

In this manner, since the sleeve serves to determine which of the delivery pressure of the hydraulic pump or the load pressure is higher and the spool functions as a hold check valve, it is unnecessary to provide a hold check valve between the pressure compensating valve and the directional control valve and the sleeve can be arranged around the outer periphery of the spool without affecting the size of the valve unit, so that the valve unit can be simplified.

(2) Also, to achieve the above second object, the present invention provides a pressure compensating valve according to the above (1), further comprising a signal fluid passage provided in the step-shaped spool, to which the outlet pressure of the metering throttle is introduced, and a check valve provided at the end portion of the smaller diameter portion of the spool on the same side as the second pressure receiving chamber and configured to operate in an opening direction to generate a new signal pressure when the, outlet pressure of the metering throttle introduced in the signal fluid passage becomes higher than the signal pressure in the fourth pressure receiving chamber.

By assembling the check valve in the spool of the pressure compensating valve in such a manner, it is unnecessary to provide a portion for disposing a shuttle valve in the load pressure signal line, so that the valve unit can also be simplified.

(3) Furthermore, to achieve the above third object, the present invention provides a pressure compensating valve according to the above (2), wherein the check valve has a valve stem fitted in the smaller diameter portion of the spool on the same side as the second pressure receiving chamber, and a slit into which the delivery pressure of the hydraulic pump is introduced is formed on the valve stem whereby when the check valve is operated in the opening direction, the slit is brought into communication with the fourth pressure receiving chamber to reduce the delivery pressure of the hydraulic pump to generate the signal pressure.

By reducing the delivery pressure of the hydraulic pump by the check valve to produce a signal pressure, but not outputting the pressure in the signal fluid passage (the outlet pressure of the metering throttle) directly in such a manner, an abnormal operation of the actuator due to the load pressure detection and transmission of the highest load pressure when the magnitudes of the load pressures are reversed is prevented from occurring, so that the operation of the actuator is not deteriorated.

BEST MODE FOR IMPLEMENTING THE INVENTION

A first embodiment of the present invention will be explained with reference to FIGS. 1 to 4.

Figure 1:
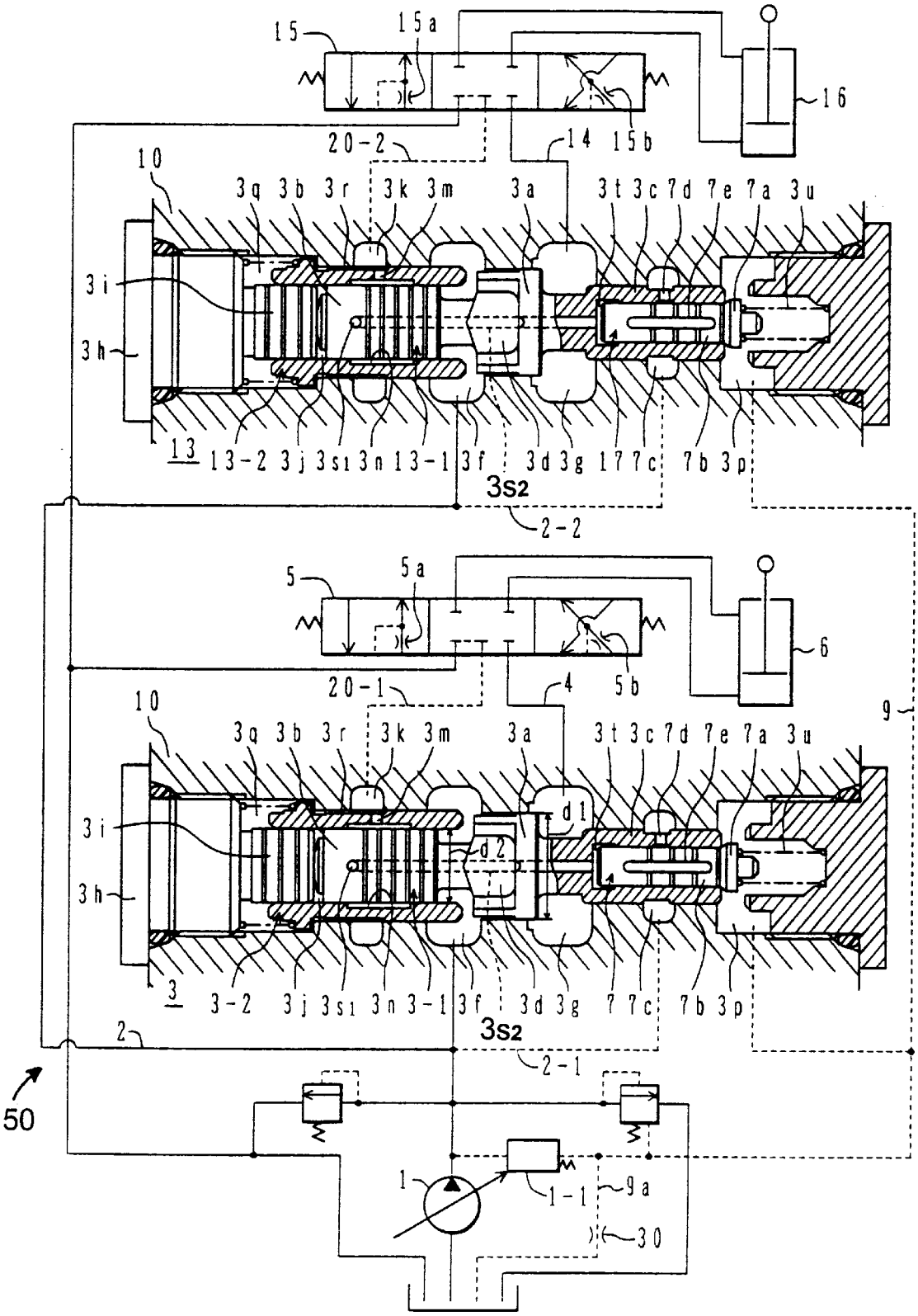
FIG. 1 is a view showing a hydraulic drive circuit configured with a valve unit including a pressure compensating valve according to a first embodiment of the present invention.

In FIG. 1, reference numeral 1 denotes a hydraulic pump, and the hydraulic pump 1 has a tilting control device 1—1 for controlling a pump delivery rate. A delivery line 2 of the hydraulic pump 1 is connected to actuators 6, 16 via a valve unit 50. The valve unit 50 includes pressure compensating valves 3, 13 of the present invention and directional control valves 5, 15. The pressure compensating valves 3, 13 are connected in parallel to the delivery line 2, and the inlet sides of the directional control valves 5, 15 are respectively connected to outlet lines 4, 14 of the pressure compensating valves 3, 13 while the outlet sides of the directional control valves 5, 15 are respectively connected to the actuators 6, 16.

The pressure compensating valves 3, 13 respectively include diametrally step-shaped spools 3-1, 13-1, sleeves 3-2, 13-2 fitted on outer peripheries of the spools 3-1, 13-1, and check valves 7, 17 fitted in the spools 3-1, 13-1. The structure of the pressure compensating valve 3 will be explained in detail below, but the same is true for the pressure compensating valve 13.

The spool 3-1 includes a larger diameter portion 3*a* having a diameter d1 and smaller diameter portions 3*b*, 3*c* having a diameter d2 and positioned at opposed sides of the larger diameter portion 3*a*, and flow control notches 3*d* are formed on the larger diameter portion 3*a*. The spool 3-1 is slidably inserted into a portion of a casing 10 of the directional control valve 5, and pressure receiving chambers 3*f*, 3*g* are provided at positions between which the larger diameter portion 3*a* of the spool 3-1 is interposed. The pressure receiving chamber 3*f* communicates with an inlet port connected to the delivery line 2 of the hydraulic pump 1 and the delivery pressure of the hydraulic pump 1 is introduced to act on a pressure receiving area of the larger diameter portion 3*a* on the left side in the figure formed by a difference between the larger diameter portion 3*a* and the smaller diameter portion 3*b*, thereby urging the spool 3-1 in a direction in which the flow control notches 3*d* are opened. The pressure receiving chamber 3*g* communicates with an outlet port connected to the outlet line 4 and when the directional control valve 5 is operated, an inlet pressure of the metering throttle 5*a* or 5*b* of the directional control valve 5 is introduced to act on a pressure receiving area of the larger diameter portion 3*a* on the right side in the figure formed by a difference between the larger diameter portion 3*a* and the smaller diameter portion 3*c*, thereby urging the spool 3-1 in a direction in which the flow control notches 3*d* are closed.

The sleeve 3-2 is fitted on the smaller diameter portion 3*b* of the spool 3-1, and the check valve 7 is fitted in the smaller diameter portion 3*c* of the spool 3-1.

A piston 3*i* having the same diameter as that of the smaller diameter portion 3*b* is retained by a cap bolt 3*h* at an end face side of the smaller diameter portion 3*b* of the spool 3-1, the sleeve 3-2 is also fitted on the piston 3*i*, so that a pressure receiving chamber 3*j* is formed in the sleeve 3-2 between the piston 3*i* and the smaller diameter portion 3*b*. A signal pressure detecting port 3*k* in which the outlet pressure of the metering throttle 5*a* or 5*b* of the directional control valve 5 is introduced via a signal detecting line 20-1 is formed around the sleeve 3-2, and the signal pressure detecting port 3*k* is brought into communication with the pressure receiving chamber 3*j* through a small hole 3*m* and an inner peripheral groove 3*n* formed in the sleeve 3-2 when the sleeve 3-2 is moved from its illustrated position to a position where it abuts with the cap bolt 3*h* (described later). This allows the outlet pressure of the metering throttle 5*a* or 5*b* to be introduced in the pressure receiving chamber 3*j*, so that the pressure acts on the end face of the smaller diameter portion 3*b* of the spool 3-1. On the other hand, a pressure receiving chamber 3*p* in which a signal pressure in a load pressure signal line 9 is introduced is provided at a portion where an end face of the smaller diameter portion 3*c* of the spool 3-1 is positioned, so that the signal pressure acts on the end face of the smaller diameter portion 3*c*.

Furthermore, a pressure receiving chamber 3*q* is formed around the piston 3*i* between the cap bolt 3*h* and the sleeve 3-2, and the pressure receiving chamber 3*q* communicates with the signal pressure detecting port 3*k* via a slit 3*r* formed on the outer periphery of the sleeve 3-2, so that the outlet pressure of the metering throttle 5*a* or 5*b* is introduced to the pressure receiving chamber 3*g*. Then, since an end face of the sleeve 3-2 on the right side in the figure is positioned in the pressure receiving chamber 3*f* and an end face thereof on the left side is positioned in the pressure receiving chamber 3*q*, and the delivery pressure of the hydraulic pump 1 acts in the pressure receiving chamber 3*f*, the sleeve 3-2 is moved in the left in the figure when the delivery pressure of the hydraulic pump 1 becomes higher than the pressure of the signal pressure detecting port 3*k* (the outlet pressure of the metering throttle 5*a* or 5*b*), so that as mentioned above, the outlet pressure of the metering throttle 5*a* or 5*b* is introduced in the pressure receiving chamber 3*j* to act on the end face of the smaller diameter portion 3*b*.

In this connection, the relationship between the diameter d1 of the larger diameter portion 3*a* and the diameter d2 of the smaller diameter portion 3*b* is d1>d2, as is already clear. Also, a difference between the pressure receiving areas of the larger diameter portion 3*a* and the smaller diameter portion 3*b* and a difference between the pressure receiving areas of the larger diameter portion 3*a* and the smaller diameter portion 3*c* are set to be equal to the pressure receiving areas of the smaller diameter portions 3*b*, 3*c* as far as a change in performance characteristics is not required. When it is desired to change the performance characteristics, the areas may be slightly different from each other, and in this case, the areas become "almost" equal to each other.

The check valve 7 serves to produce a pressure in the load pressure signal line 9 from the outlet pressure of the metering throttle 5*a* or 5*b* (the load pressure in the actuator 6), and is provided at an end portion of the smaller diameter portion 3*c* of the spool 3-1 where the pressure receiving chamber 3*p* is positioned, and the pressure in the pressure receiving chamber 3*p* acts on the check valve 7 in a closing direction. In the spool 3-1, signal fluid passages 3*s*1, 3*s*2 and a pressure receiving chamber 3*t* communicating with the signal pressure detecting port 3*k* via the small hole 3*m* and the inner peripheral groove 3*n* provided in the sleeve 3-2 are provided, and the check valve 7 is inserted into a hole forming the pressure receiving chamber 3*t*, and the outlet pressure of the metering throttle 5*a* or 5*b* introduced in the pressure receiving chamber 3*t* acts on the check valve 7 in an opening direction, so that when the outlet pressure of the metering throttle becomes higher than the signal pressure in the pressure receiving chamber 3*p*, the check valve 7 is moved in the opening direction. Reference numeral 3*u* denotes a weak holding spring for retaining the check valve at a closed position when not being operated.

In this embodiment, the check valve 7 is configured as a pressure-reducing valve such that upon opening it does not directly output the outlet pressure of the metering throttle 5*a* or 5*b* (load pressure) introduced in the signal fluid passages 3*s*1, 3*s*2, but produces a pressure corresponding to the load pressure by reducing the delivery pressure of the hydraulic pump 1.

More specifically, the check valve 7 comprises a valve body 7*a* and a valve stem 7*b* unified as one body with the valve body 7*a* and inserted in the smaller diameter portion 3*c* of the spool 3-1, with an end face of the valve stem 7*b* facing the pressure receiving chamber 3*t*. Also, a pump port 7*c* to which the delivery pressure of the hydraulic pump 1 is introduced via a fluid passage 2-1 branching from the delivery line 2 is formed around the smaller diameter portion 3*c*, and a slit 7*e* communicating with the pump port 7*c* via a small hole 7*d* formed in the smaller diameter portion 3*c*, to which the delivery pressure of the hydraulic pump 1 is introduced, is formed on the valve stem 7*b*. When the check valve 7 is actuated in the opening direction, i.e., in the right in the figure, the slit 7*e* is caused to communicate with the pressure receiving chamber 3*p*, and thus the delivery pressure of the hydraulic pump 1 is reduced to produce the signal pressure.

A restrictor 30 is provided in a line 9*a* in the load pressure signal line 9 connected to a tank T such that the spool 3-1 and the check valve 7 can be moved.

Operations of the pressure compensating valves 3-1, 13-1 of the valve unit 50 configured in the above manner will be explained further with reference to FIGS. 2 to 4. In the following explanation, it is assumed that the load pressure of the actuator 6 connected to the directional control valve 5 is higher than that of the actuator 16 connected to the directional control valve 15.

Figure 2:
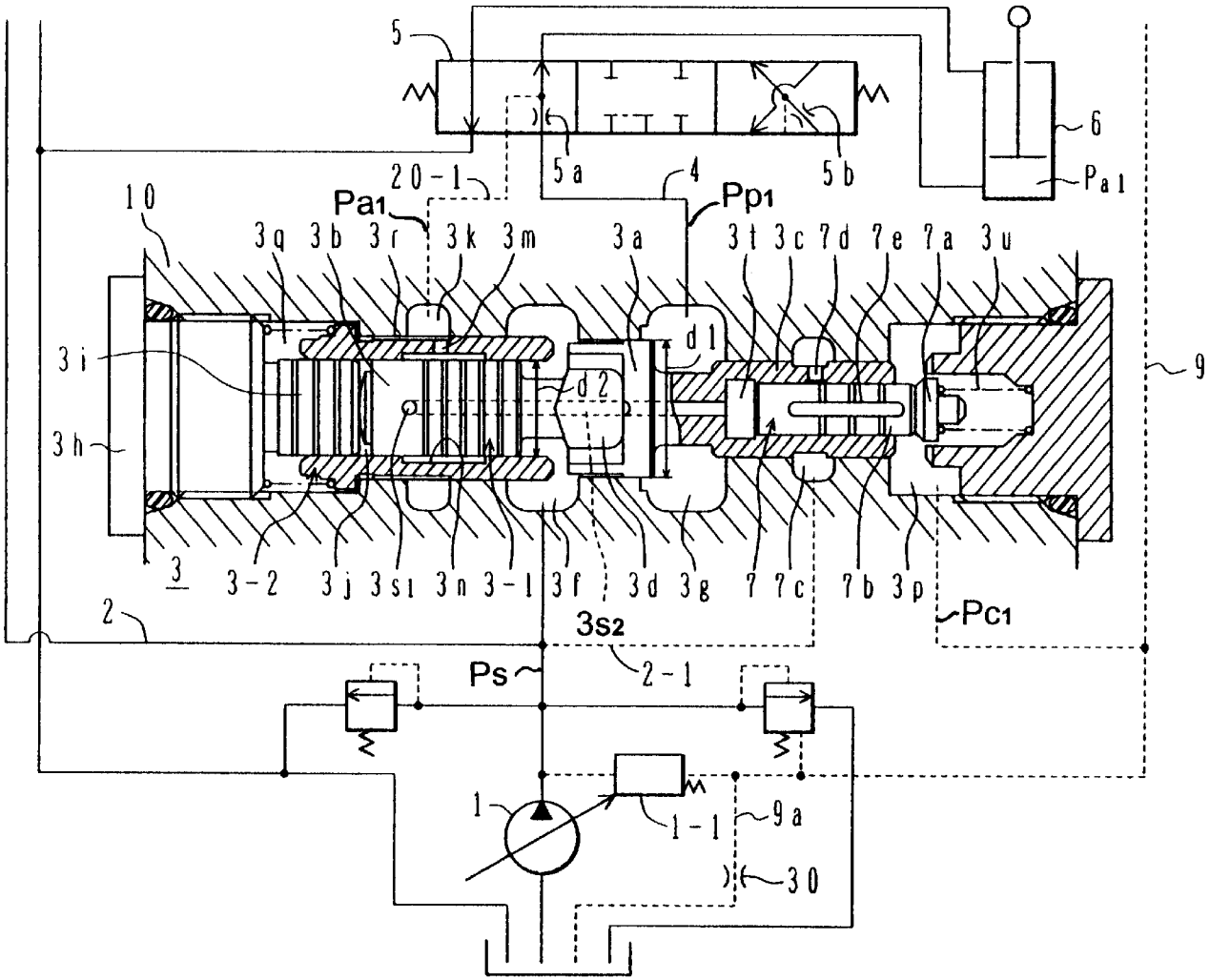
FIG. 2 is a view explaining an operation of the pressure compensating valve immediately after a directional control valve is operated.
Figure 3:
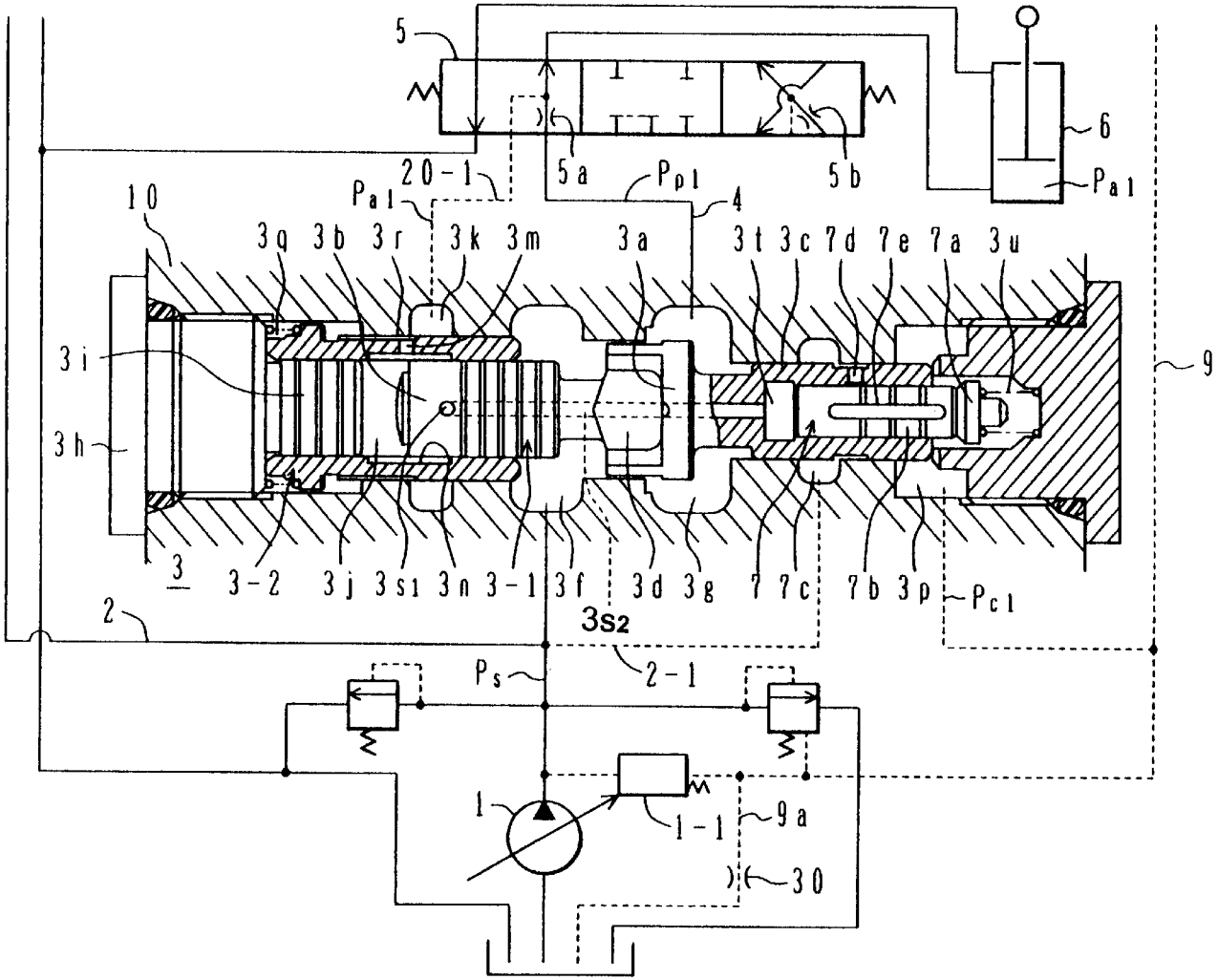
FIG. 3 is a view explaining a following operation of the pressure compensating valve after the directional control valve is operated.

In order to move the actuator 6 upwardly, the directional control valve 5 is operated to move in the right as shown in FIG. 2. According to this operation, a load pressure Pa1 of the actuator 6 is introduced into the signal detecting passage 20-1 and the signal detecting port 3*k* and the load pressure Pa1 is further introduced to the pressure receiving chamber 3*t* through the signal fluid passages 3*s*1, 3*s*2 provided in the spool 3-1, so that the load pressure Pa1 is applied to the end face of the valve shaft 7*b* of the check valve 7 fitted in the spool 3-1. Immediately after the operation of the directional control valve 5, the delivery pressure Ps of the hydraulic pump 1 is lower than the pressure Pp1 in the outlet line 4 of the pressure compensating valve 3 (Pp1=Pa1 when no flow is passing through the metering throttle 5*a* of the directional control valve 5), and since the pressure receiving chamber 3*f* and the pressure receiving chamber 3*g* on which the respective pressures act are opposed from each other through the larger diameter portion 3*a*, the spool 3-1 is held at a position shown in FIG. 1. Also, since the load pressure Pa1 is introduced in the pressure receiving chamber 3*q* where the end portion of the sleeve 3-2 on the left side in the figure is positioned and the load pressure Pa1 is higher than the delivery pressure Ps of the hydraulic pump 1 in the pressure receiving chamber 3*f* where the end portion of the sleeve 3-2 on the right side in the figure is positioned, the sleeve 3-2 is also held at a position shown in FIG. 1.

On the other hand, in this state, the load pressure Pa1 which has been introduced in the signal fluid passages 3*s*1, 3*s*2 and the pressure receiving chamber 3*t* moves the check valve 7 in the right in the figure. This movement causes the slit 7*e* provided on the outer periphery of the valve stem 7*b* of the check valve 7 to be opened in the pressure receiving chamber 3*p* is the right side of the spool 3-1 in the figure, so that the delivery pressure Ps of the hydraulic pump 1 is introduced into the pressure receiving chamber 3*p* via the small hole 7*d* and the slit 7*e*. When this pressure is increased to be higher than the load pressure Pa1, the check valve 7 is moved in the left in the figure to close the slit 7*e*. As a result, a pressure equivalent to the load pressure Pa1 is produced in the pressure receiving chamber 3*p* by the delivery pressure Ps of the hydraulic pump 1.

The pressure in the pressure receiving chamber 3*p* is transmitted to the tilting control device 1—1 via the load pressure signal line 9 as a detected signal pressure Pc1. This signal transmission causes the delivery rate of the hydraulic pump 1 to be increased, so that the delivery pressure Ps is raised. When the delivery pressure Ps exceeds the load pressure Pa1 introduced in the pressure receiving chamber 3*q*, the sleeve 3-2 is moved in the left in the figure, and thus the load pressure Pa1 is introduced in the pressure receiving chamber 3*j*, so that a state shown in FIG. 3 is obtained. In this state, the spool 3-1 is balanced at a position where a differential pressure (Ps−Pc1) between the delivery pressure Ps and the detected signal pressure Pc1 acting in the pressure receiving chambers 3*f*, 3*p* and a differential pressure (Pp1−Pa1) between the pressure Pp1 in the outlet line 4 and the load pressure Pa1 acting in the pressure receiving chambers 3*g*, 3*j* are equal to each other. The pump delivery pressure Ps and the detected signal pressure Pc1 are transmitted to the tilting control device 1—1 of the hydraulic pump 1, and the hydraulic pump 1 controls its delivery rate such that a difference between those pressures is made equal to a certain set value ΔP1. At this time, assuming that the force of the spring 3*u* provided for the check valve 7 is so small that it can be ignored, the load pressure Pa1 and the detected signal pressure Pc1 become almost equal to each other due to the force balance in the check valve 7, so that the pump delivery pressure Ps and the pressure Pp1 also become almost equal to each other. Namely, the spool 3-1 is fully opened. At this time, the differential pressure Pp1−Pa1 across the metering throttle 5*a* of the directional control valve 5 becomes equal to the set differential pressure ΔP1 for the tilting control device 1—1.

Next, reference is made in a case where the actuator 16 is further operated simultaneously when the actuator 6 is operated in the above manner. As mentioned above, it is presumed that a load pressure Pa2 detected in a signal detecting line 20-2 is lower than the load pressure Pa1. The delivery pressure Ps of the hydraulic pump 1 and the detected signal pressure Pc1 are introduced in the pressure receiving chambers 3*f*, 3*p* of the pressure receiving valve 13.

When the directional control valve 15 is positioned in a neutral position, the spool 13-1 is urged in the left in the figure by the hydraulic force of the detected signal pressure Pc1 and the sleeve 13-2 is likewise moved in the left so that the state shown in FIG. 1 is held, even when the pump delivery pressure Ps is introduced in the pressure receiving chamber 3*g* of the pressure compensating valve 13.

Figure 4:
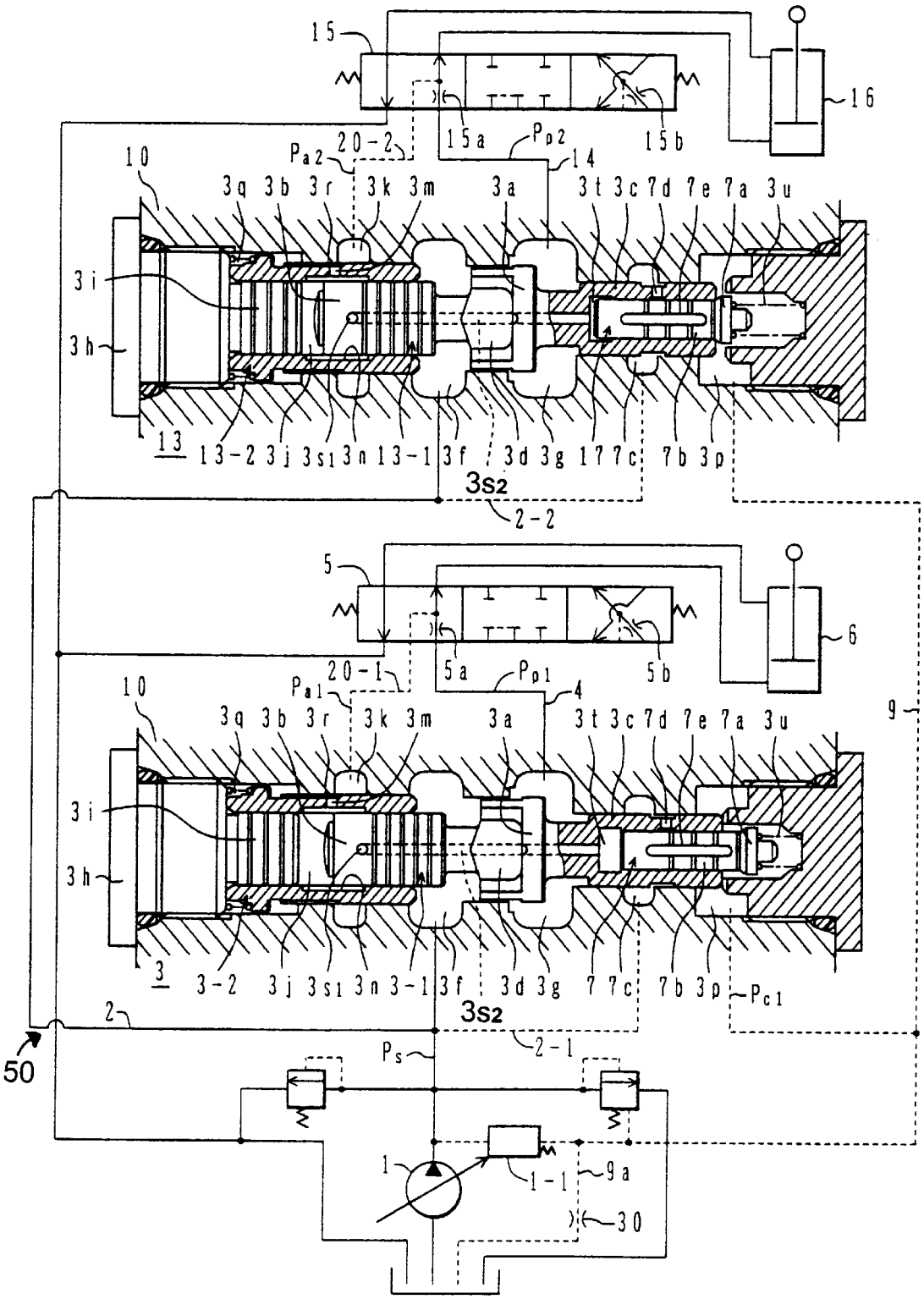
FIG. 4 is a view explaining operations of the pressure compensating valves when the two directional control valves are simultaneously operated.

When the directional control valve 15 is operated, a pressure Pp2 in the outlet line 14 of the pressure compensating valve 13, i.e., in the pressure receiving chamber 3*g*, is lowered due to Pa2<Pa1, and the spool 13-1 is moved in the right as shown in FIG.4. Also, the load pressure Pa2 of the actuator 16 is introduced in the pressure receiving chamber 3*q* of the pressure compensating valve 13. Since a force balance in the spool 13-1 in this state is established when the differential pressure (Ps−Pc1) and the differential pressure (Pp2−Pa2) become equal to each other like the case of the above pressure compensating valve 3, the differential pressure Pp2−Pa2 across the metering throttle 15*a* of the directional control valve 15 also becomes equal to the set differential pressure ΔP1 of the tilting control device 1—1.

In the pressure compensating valve 3 at a higher pressure side, the spool 3-1 is operated in a full opening direction such that the delivery pressure Ps of the hydraulic pump and the pressure Pp1 in the outlet line 4 are almost equal to each other, but in the pressure compensating valve 13 at a lower pressure side, the delivery pressure Ps of the hydraulic pump 1 and the pressure Pp2 in the outlet line 14 are different from each other, and thus the spool 13-1 is caused to be balanced at an opening degree position where the pump delivery pressure Ps is reduced to the pressure Pp2 in the outlet line 14 between the pressure receiving chamber 3*f* and the pressure receiving chamber 3*g*.

The above explanation is directed to a case where the delivery fluid amount of the hydraulic pump 1 is sufficient to meet a required fluid amount of the directional control valves 5, 15. However, even when the delivery fluid amount of the hydraulic pump 1 is insufficient for the required fluid amount and the differential pressure Ps−Pc1 is lowered below the set differential pressure ΔP1 so that the differential pressure Pp1−Pa1 across the directional control valve 5 at the higher pressure side can not be held at the set differential pressure ΔP1, the pressure compensating valves 3, 13 are operated such that the differential pressures across the metering throttles 5*a*, 15*a* of the directional control valves 5, 15 at both of the higher and lower pressure sides become equal to that lowered differential pressures (Ps−Pc1), so that a fluid is prevented from flowing to the lower pressure side preferentially.

As above-mentioned, in this embodiment, since the first to fifth pressure receiving chambers 3*f*, 3*g*, 3*j*, 3*p* and 3*q* are provided in the pressure compensating valves 3 and 13 and the sleeve 3-2 or 13-2 is fitted on the outer periphery of the smaller diameter portion 3*b* of the spool, when the directional control valve 5 or 15 is operated, the sleeve 3-2 or 13-2 is not moved while the delivery pressure of the hydraulic pump 1 is lower than the outlet pressure of the metering throttle 5*a* or 5*b*, or 15*a* or 15*b* (the load pressure of the actuator 6 or 16), and thus the outlet pressure of the metering throttle is not introduced in the third pressure receiving chamber 3*j*. Accordingly, the spool 3-1 or 13-1 is held at a position where the control notches 3*d* of the larger diameter portion 3*a* are closed, and the communication between the first pressure receiving chamber 3*f* and the second pressure receiving chamber 3*q* is cut off, so that a reverse flow of the load pressure is prevented from occurring.

When the delivery pressure of the hydraulic pump 1 is raised to exceed the outlet pressure of the metering throttle (the load pressure of the actuator 6 or 16), the sleeve 3-2 or 13-2 is moved so as to introduce the outlet pressure of the metering throttle to the third pressure receiving chamber 3*j*. Thus, the spool 3-1 or 13-1 is moved in a direction to open the control notches 3*d* of the larger diameter portion 3*a*, and the first pressure receiving chamber 3*f* and the second pressure receiving chamber 3*g* are brought into communication with each other, so that the hydraulic fluid of the hydraulic pump 1 is supplied to the directional control valve 5 or 15.

In this manner, since the sleeve 3-2 or 13-2 serves to determine which of the delivery pressure of the hydraulic pump 1 or the load pressure is higher and the spool 3-1 or 13-1 functions as a hold check valve, it is unnecessary to provide a hold check valve between the pressure compensating valve 3 or 13 and the directional control valve 5 or 15 and the sleeve 3-2 or 13-2 can be arranged around the outer periphery of the spool without affecting the size of the valve unit 50, so that the valve unit 50 can be simplified.

Also, since the check valve 7 or 17 is assembled in the spool 3-1 or 13-1 of the pressure compensating valve 3 or 13, it is unnecessary to provide a portion for disposing a shuttle valve in the load pressure signal line 9 thereby simplifying the valve unit 50 as well.

Furthermore, since the check valve 7 or 17 reduces the delivery pressure of the hydraulic pump 1 to produce a signal pressure but not outputs the pressure in the signal fluid passage 3*s*1, 3*s*2 (the outlet pressure of the metering throttle) directly, an abnormal operation of the actuator 6 or 16 due to ventilation of the signal pressure generated along with the load pressure detection and the transmission of the highest load pressure when the magnitudes of the load pressures are reversed is prevented from occurring, so that the operation of the actuator is not deteriorated.

Figure 5:
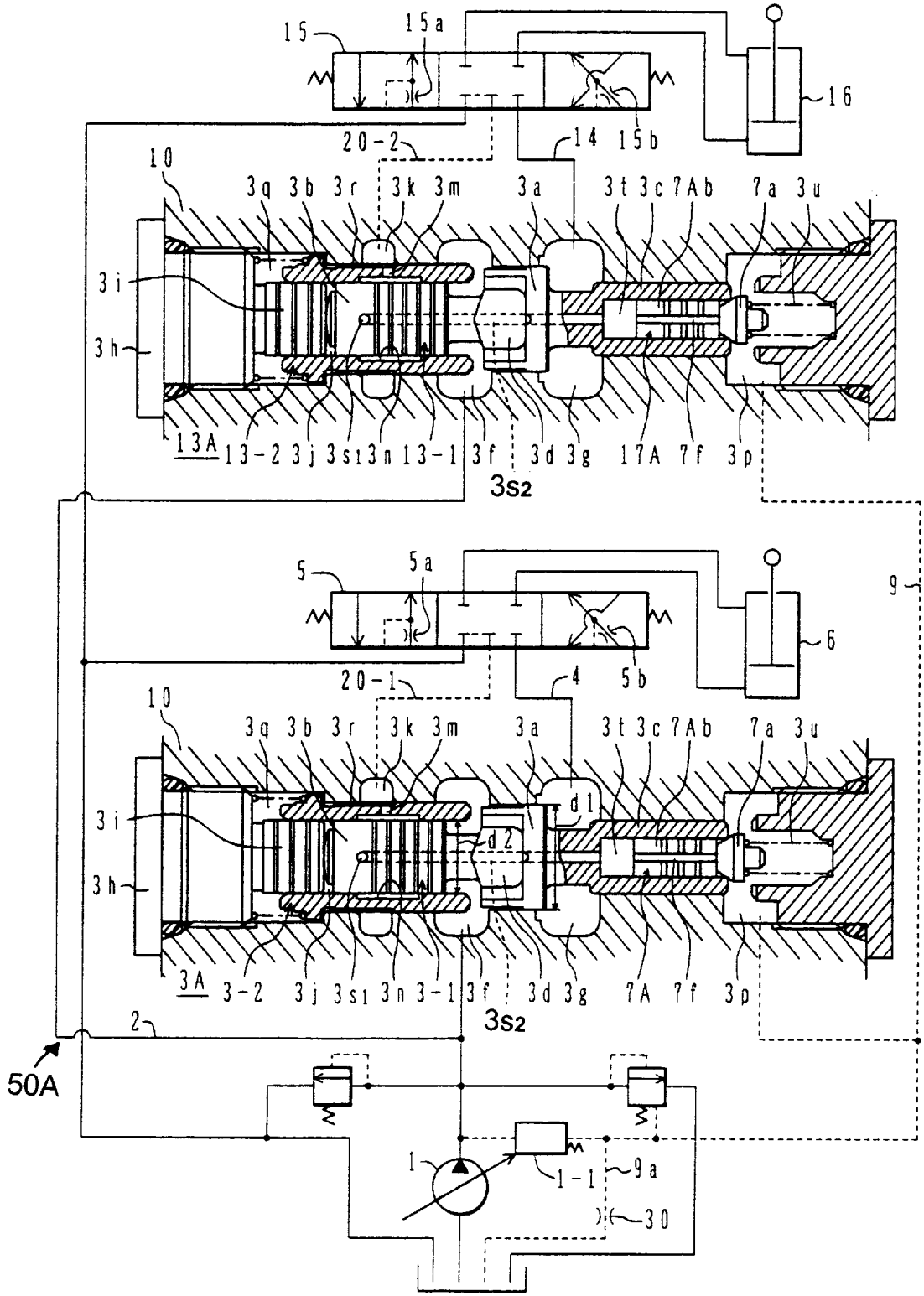
FIG. 5 is a view showing a hydraulic drive circuit configured with a valve unit including a pressure compensating valve according to a second embodiment of the present invention.
Figure 6:
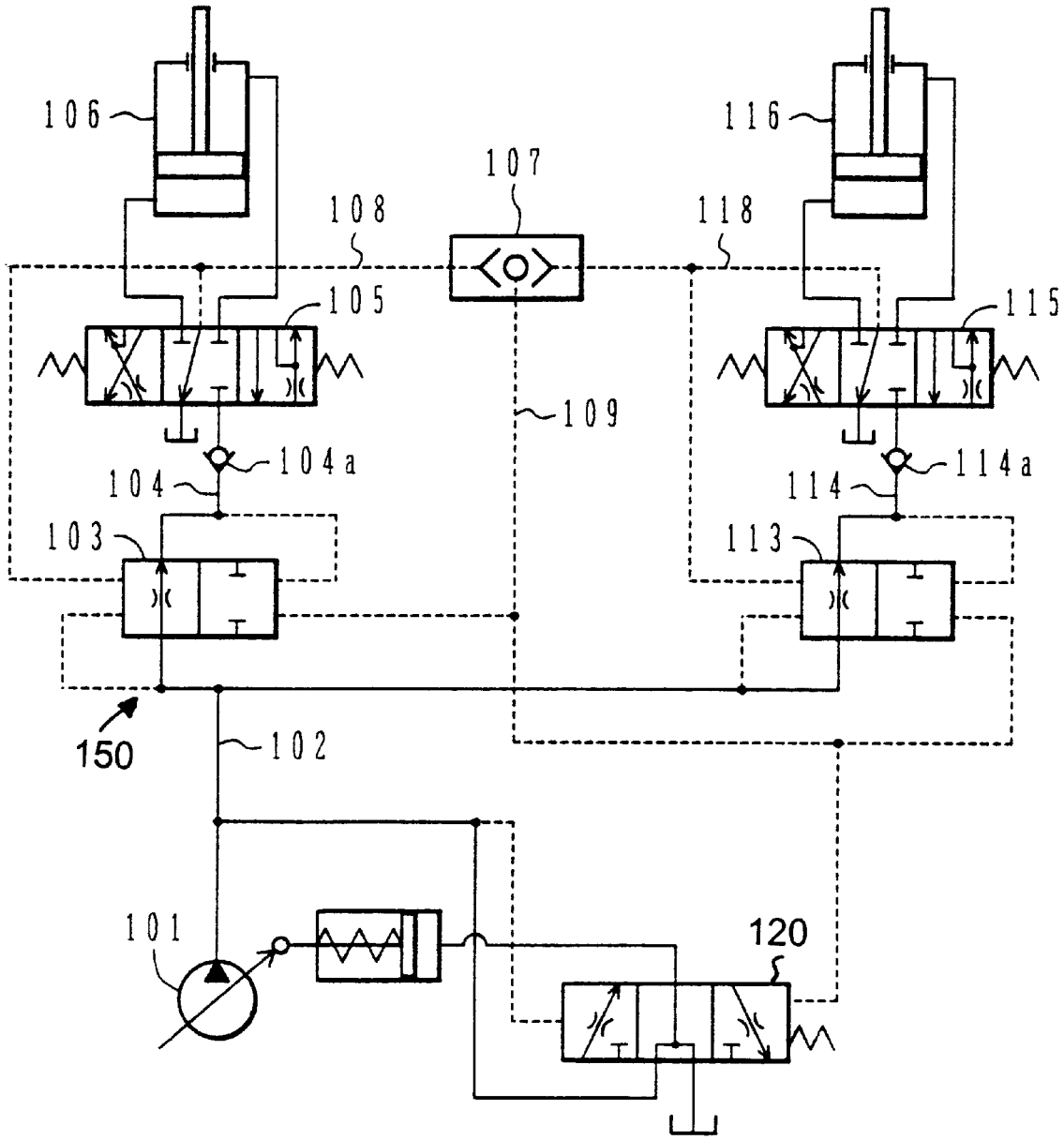
FIG.6 PRIOR ART
FIG. 6 is a view showing a hydraulic drive circuit configured with a valve unit including a conventional pressure compensating valve.

A second embodiment of the present invention will be explained with reference to FIG. 5. In FIG. 5, the same members or the like as those in FIG. 1 are given the same reference numerals. The present embodiment is configured such that the check valve outputs the outlet pressure of the metering throttle (the load pressure) directly to produce a detected signal pressure.

In FIG. 5, a valve unit 50A comprises pressure compensating valves 3A, 13A according to this embodiment and the pressure compensating valves 3A, 13A respectively include check valves 7A, 17A. Each of the check valves 7A, 17A has a valve stem 7A*b* unified with the valve body 7*a* and inserted in the smaller diameter portion 3*c* of the spool 3-1 or 13-1, with an end face of the valve stem 7A*b* facing the pressure receiving chamber 3*t*. Also, a slit 7*f* is formed on an outer periphery of the valve stem 7A*b* over its entire length. When the check valve 7A or 17A is operated in the right side opening direction in the figure, the pressure receiving chamber 3*t* is brought into communication with the pressure receiving chamber 3*p* via the slit 7*f*, so that the outlet pressure of the metering throttle 5*a* or 5*b* (the load pressure) introduced in the signal fluid passage 3*s*1, 3*s*2 is output as the detected signal pressure.

In this embodiment, also, since the spool 3-1 or 13-1 is provided with a function of a hold check valve by movement of the sleeve 3-2 or 13-2, it is unnecessary to arrange a hold check valve between the pressure compensating valve 3 or 13 and the directional control valve 5 or 15, and since the check valve 7A or 17A is assembled in the spool 3-1 or 13-1 of the pressure compensating valve 3A or 13A, it is unnecessary to provide a portion for disposing a shuttle valve in the load pressure signal line 9, thereby simplifying the valve unit 50A.

INDUSTRIAL APPLICABILITY

According to the present invention, since it is unnecessary to provide a portion for arranging a hold check valve between the pressure compensating valve and the directional control valve, the valve unit can be simplified.

Also, since it is unnecessary to provide a portion for disposing a shuttle valve in the load pressure signal line, the valve can be further simplified.

Furthermore, an abnormal operation of the actuator due to the load pressure detection and transmission of the highest load pressure when the magnitudes of the load pressures are reversed is prevented from occurring, so that the operation of the actuator is not deteriorated.

What is claimed is:

1. A pressure compensating valve disposed at an inlet side of a metering throttle of a directional control valve for controlling a differential pressure between inlet and outlet pressures of the metering throttle so that the differential pressure corresponds to a differential pressure between a delivery pressure of a hydraulic pump and a signal pressure in a signal line comprising:

a step-shaped spool having a larger diameter portion and smaller diameter portions positioned at opposed sides of the larger diameter portion, the larger diameter portion being formed with flow control notches;

first and second pressure receiving chambers disposed to sandwich the larger diameter portion of the spool for respectively applying a delivery pressure of the hydraulic pump in a direction opening the flow control notches and the inlet pressure of the metering throttle of the directional control valve in a direction closing the flow control notches;

a third pressure receiving chamber disposed at an end of the smaller diameter portion of the spool on the same side as the first pressure receiving chamber;

a fourth pressure receiving chamber disposed at an end of the smaller diameter portion on the same side as the second pressure receiving chamber;

a fifth pressure receiving chamber disposed on the same side as the third pressure receiving chamber with respect to the larger diameter portion and to which the outlet pressure of the metering throttle is introduced; and a sleeve slidably fitted on an outer periphery of the smaller diameter portion of the spool on the same side as the first pressure receiving chamber and having opposed ends respectively positioned in the first pressure receiving chamber and the fifth pressure receiving chamber whereby the sleeve is moved so as to introduce the outlet pressure of the metering throttle to the third pressure receiving chamber when the delivery pressure of the hydraulic pump in the first pressure receiving chamber becomes higher than outlet pressure of the metering throttle in the fifth pressure receiving chamber.

2. A pressure compensating valve according to claim 1, further comprising a signal fluid passage provided in the step-shaped spool, to which the outlet pressure of the metering throttle is introduced, and a check valve provided at the end portion of the smaller diameter portion of the spool on the same side as the second pressure receiving chamber and configured to operate in an opening direction to generate a new signal pressure when the outlet pressure of the metering throttle introduced in the signal fluid passage becomes higher than the signal pressure in the fourth pressure receiving chamber.

3. A pressure compensating valve according to claim 2, wherein the check valve has a valve stem fitted in the smaller diameter portion of the spool on the same side as the second pressure receiving chamber, and a slit into which the delivery pressure of the hydraulic pump is introduced is formed on the valve stem whereby when the check valve is operated in the opening direction, the slit is brought into communication with the fourth pressure receiving chamber to reduce the delivery pressure of the hydraulic pump to generate the signal pressure.

* * * * *